United States Patent [19]

Scott et al.

[11] Patent Number: 4,937,556

[45] Date of Patent: Jun. 26, 1990

[54] WINDOW GUARD MONITORING SYSTEM AND GUARD

[76] Inventors: Avery D. Scott; Donald R. Vessell, both of 2390 E. Cherrywood Dr., Lafayette, Colo. 80026

[21] Appl. No.: 252,982

[22] Filed: Oct. 4, 1988

[51] Int. Cl.[5] ..... G08B 13/08; G08B 17/10

[52] U.S. Cl. ..... 340/545; 49/13; 49/14; 49/31; 340/628; 340/691

[58] Field of Search ..... 49/31, 1, 13, 14; 340/691, 545, 628

[56] References Cited

U.S. PATENT DOCUMENTS

| | | | |
|---|---|---|---|
| 2,640,123 | 5/1953 | Cahusac et al. | 200/61.03 |
| 3,042,907 | 7/1962 | Redway | 200/61.03 |
| 3,848,242 | 11/1974 | Campagna | 340/545 |
| 4,092,641 | 5/1978 | Bellinghausen et al. | 340/409 |
| 4,237,654 | 12/1980 | Landem et al. | 49/13 |
| 4,304,070 | 12/1981 | Musacchia | 49/31 |
| 4,533,904 | 8/1985 | Steinman, Jr. | 200/61.03 |
| 4,600,314 | 7/1986 | Theriault | 340/628 |
| 4,685,316 | 8/1987 | Hicks et al. | 49/31 |
| 4,837,560 | 6/1989 | Newberry | 340/628 |

*Primary Examiner*—Glen R. Swann, III

[57] ABSTRACT

A window security system including a door disposed over a window and moveable between a closed position and an open position. The door may be selectively locked in the closed position by an electrically actuated lock. The system further includes a smoke detector and an actuator for automatically unlocking the door when the smoke detector detects smoke. The system also includes manual override features for unlocking the door even when the smoke detector detects smoke and also for preventing the door from unlocking when the smoke detector detects smoke. The system may also include audible or visual signals for indicating whether the door is in the open position.

10 Claims, 2 Drawing Sheets

WINDOW GUARD MONITORING SYSTEM AND GUARD

BACKGROUND OF THE INVENTION

The present invention relates to a window security system especially adapted to prohibit the entry through the window by a burglar or other unauthorized person, while permitting free passage through the window during an emergency.

The basement windows and first floor windows of houses, apartment buildings, and office buildings are often covered by metal bars in order to prevent unauthorized entrance through the window and into the building by burglars and other unauthorized persons. If the building should catch on fire, then these windows covered with bars form a prison which prevents a person inside the building from exiting the building through the windows.

SUMMARY OF THE INVENTION

The present invention relates to a window security system including a door disposed over a window and moveable between a closed position and an open position. The door may be selectively locked in the closed position by an electrically actuated lock. The system further includes a smoke detector and an actuator for automatically unlocking the door when the smoke detector detects smoke. The system also includes manual override features for unlocking the door even when the smoke detector detects smoke and also for preventing the door from unlocking when the smoke detector detects smoke. The system may also include audible or visual signals for indicating whether the door is in the open position.

BRIEF DESCRIPTION OF THE DRAWINGS

The present invention will be described with reference to the accompanying drawings, wherein.

DESCRIPTION OF A PREFERRED EMBODIMENT

Figure 1:
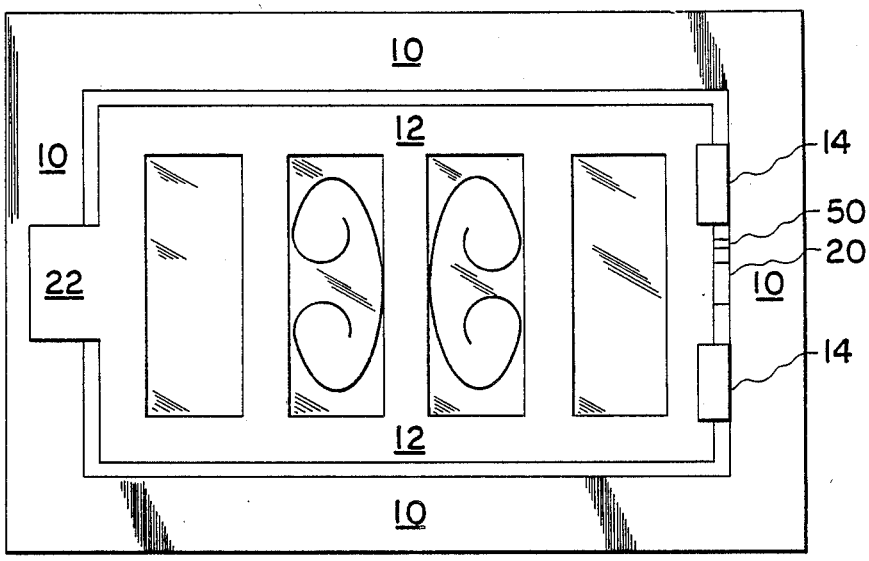
FIG. 1 is a plan view of a window and door assembly used in an embodiment of the security system of the present invention.

The present invention will be described with reference to the accompanying drawings wherein like reference numerals refer to the same item.

The window security system is adapted for use with a window having a window frame 10 and a window opening substantially defined by the window frame 10. For purposes of the present invention, the window opening preferably is of a size sufficient to permit an adult person to pass therethrough. The window security system includes a door 12 having a configuration substantially conforming to the configuration of the window opening. The door 12 is rotatably mounted to the window frame 10 by a pair of hinges 14. Preferably the window frame 10, the door 12, and the hinges 14 are fashioned of metal so as to minimize the potential for their breakage by an unauthorized person attempting to gain entry through the window. Also preferably, the door 12 possesses a series of bars or grill work so as to permit light to pass therethrough.

Figure 2:
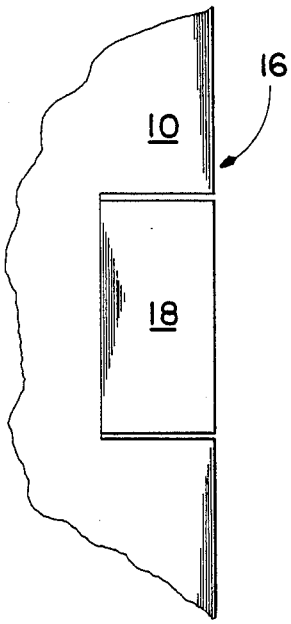
FIG. 2 is a partial plan view of an electric lock used to selectively lock the door shown in FIG. 1 in a closed position.

The end of the door 12 opposite to the door end where the hinges 14 are located is provided with a deadlock (not shown) which is adapted to protrude into an electric strike or lock 16, as best shown in FIG. 2. The electric lock 16 includes a rotatable latch plate 18 which may be maintained in a position so as to restrict and lock the deadlock from movement outwardly and away from the window frame 10 and which may be selectively rotated so as to permit such movement by the deadlock. A suitable electric lock 16 is an electric strike manufactured by Rofu located in West Germany.

Normally the door 12 is maintained in a closed, locked position within the window opening, but may be selectively swung about the hinges 14 into an open position simply by causing the latch plate 18 of the electric lock 16 to rotate into a unlocked position. To insure that the door 12 swings into an open position when the latch plate 18 is unlocked, the hinges 14 may be constructed as so-called spring hinges. Alternatively, a resilient, compressible material such as a rubber plug 20 may be wedged between the window frame 10 and the door 12. The plug 20 will be under a state of compression when the door 12 is in a closed, locked position, and will bias and force the door 12 to swing toward an open position when the latch plate 18 rotates into an unlocked position. The plug 20 may comprise a strip of material extending along the end of the door 12 and may be adhered to either the end of the door 12 or to the opposing surface of the window frame 10.

To insure that an unauthorized person does not tamper with or break either the deadlock or the electric lock 16, the door 12 is provided with a guard plate 22 that extends over the region where the deadlock and the electric lock 16 are located.

Figure 4:
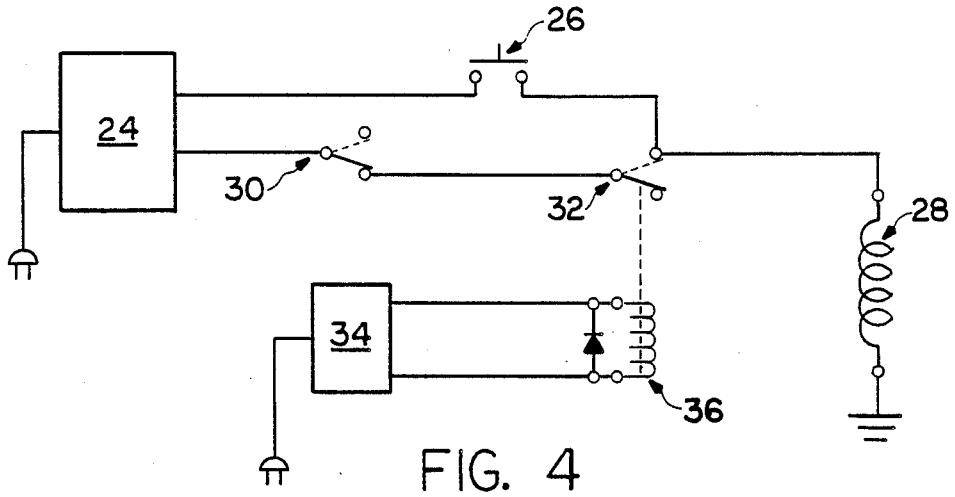
FIG. 4 is a schematic electrical circuit diagram of certain electrical components used in an embodiment of the security system of the present invention.

The window security system also includes an electrical system for controlling the operation of the electric lock 16 so as to control the position of the door 12. As best shown in FIG. 4, the control system includes a rechargeable battery 24 connected to a source of AC electric power. The battery is electrically connected through a manually operable momentary switch 26 to a solenoid 28, which when energized, causes the latch plate 18 to rotate into an unlocked position. The battery 24 is also electrically connected to the solenoid 28 through a manually operable on/off switch 30 and through an electrically actuated switch 32.

The control system further includes a smoke detector 34 connected to a source of AC electric power. A suitable smoke detector is the "First Alert" smoke-fire detector made by Pittway Corporation located at 780 McClure Road, Aurora, Ill. The smoke detector 34 is operably connected to a solenoid 36 which controls the operation of the electric switch 32.

In operation, when power is applied to the battery 24 and the smoke detector 34, the solenoid 36 is energized and causes the electric switch 32 to assume the solid line position indicated in FIG. 4. When the smoke detector 34 does not detect smoke, then the door 12 can be opened only by manually depressing the momentary switch 26 or by manually depressing the test button normally provided on the smoke detector 34. When the smoke detector 34 detects smoke, then the solenoid 36 will be deenergized, thereby causing the electric switch 32 to assume the dotted line position shown in FIG. 4, which automatically causes the door 12 to open.

The system further includes a manually operated override switch 30, which in an "on" position assumes the solid line position shown in FIG. 4, and which in an "off" position assumes the dotted line position shown in FIG. 4. If the manual operable override switch 30 is placed in an "off" position, then the only way the door 12 can be opened is by manually depressing the momentary switch 26. It will be appreciated that an operator will place the manually operable override switch in an "on" position whenever the operator desires the door 12 to open automatically when the smoke detector 34 detects smoke, such as when a person is sleeping within the house at night. On the other hand, if the operator leaves the house without occupants, or the operator is cooking a meal or smoking a cigarette within the house, then the operator might wish to place the manually operable override switch 30 in an "off" position so that if the smoke detector 34 detects smoke, then the door 12 will not open. It will be appreciated that even when the manually operable override switch 30 is in an "off" position, the door 12 still may be opened by depressing the momentary switch 26.

If the source of AC power supply is cut off, such as by a burglar cutting power lines, then the door 12 will open automatically if the manually operable switch 30 is in an "on" position, and will remain closed if the manually operated switch 30 is in an "off" position. Since the battery 24 stores electric energy, the battery 24 can provide a source of electric power to open the door 12 even when the outside source of power is cut-off.

Figure 5:
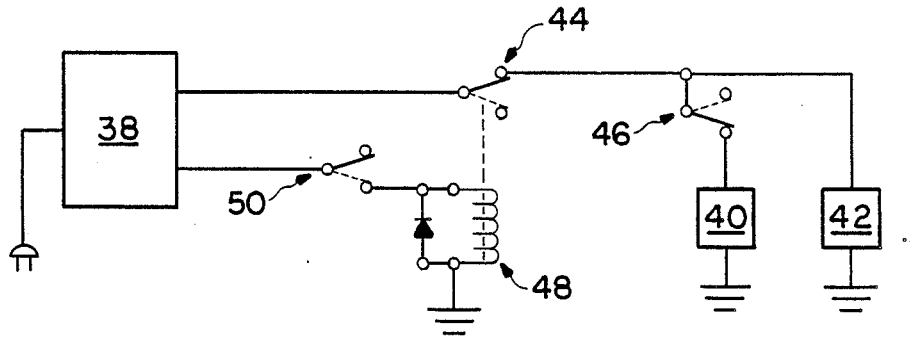
FIG. 5 is a schematic electrical circuit diagram of yet other electrical components used in an embodiment of the security system of the present invention.

The security system also includes an electrical circuit for monitoring the position of the door 12, as shown in FIG. 5. The monitoring system includes a rechargeable battery 38 connected to a source of AC electric power. The battery 38 may be the same battery as the battery 24 in FIG. 4. The battery 38 is connected to a buzzer or audible alarm 40 and to a light or visual alarm 42 through an electrically actuated switch 44 and through a manually operable override switch 46. The electrically actuated switch 44 is controlled by a solenoid 48 which is connected to the battery 38 through a depressible pin switch 50. As shown in FIG. 1, the pin switch 50 is disposed between the window frame 10 and the door 12, adjacent to the resilient, compressible plug 20. In operation, when the door 12 is closed, then the switch 50 is depressed and assumes the dotted line position shown in FIG. 5, thereby energizing the solenoid 48. When the solenoid 48 is energized, then the electric actuated switch 44 assumes the dotted line position shown in FIG. 5, and the audible and visual alarms will not be activated. When the door 12 is open, then the pin switch 50 assumes the solid line position shown in FIG. 5, thereby deenergizing the solenoid 48, which in turn causes the electric actuated switch 44 to assume the solid line position shown in FIG. 5 and thereby causes the audible and visual alarms to be activated. The manually operable override switch 46 may assume an "on" position indicated by the solid line shown in FIG. 5, or may assume an "off" position shown by the dotted line in FIG. 5. When the manually operable override switch 46 assumes an "off" position, then the audible alarm will not be activated even when the door 12 is open. It should be appreciated that in addition to both an audible alarm 40 and a visual alarm 42, the system could instead use either type of alarm or some other type of alarm.

Each different window in a building may have a separate monitor system shown in FIG. 5, so that the activation of the audio and visual alarms will indicate which door of which window is open or closed. Also, where there are several different interconnect smoke detectors within a building, the system shown in FIG. 4 can be readily adapted to cause the doors of any one or ones of several windows to be opened in response to detection of smoke by any particular smoke detector.

Figure 3:
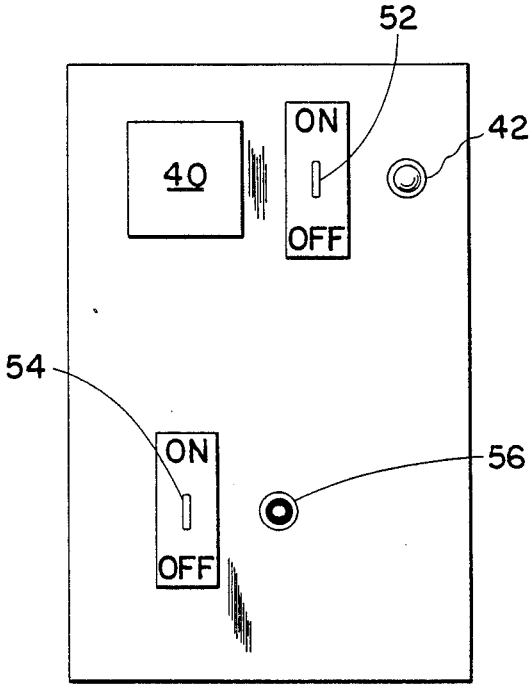
FIG. 3 is a plan view of a control panel used in an embodiment of the security system of the present invention.

There is shown in FIG. 3 an elementary control panel for the electrical system shown in FIGS. 4 and 5. The control panel includes a buzzer or audible alarm 40, a light or visual alarm 42, and a toggle control 52 for the manually operable override switch 46. The control panel also includes a second toggle 54 for controlling the manually operable override switch 30,50 and a first depressible button 56 for controlling the momentary switch 26. If there are multiple window and door assemblies, then there could be a corresponding number of audible alarms 40, visual alarms 42, toggle switches 52 and 54, and depressible buttons 56. Also, if the security system included multiple window and door assemblies, then the control panel 30 could contain a master control toggle (not shown) which would deactivate all audible alarms 40 and visual alarms 42, could contain a master control toggle (not shown) for overriding all of the manually operable override switches 30, and could contain a master depressible button (not shown) for controlling all of the momentary switches 26.

Although particular embodiments of the present invention have been described and illustrated herein, it should be recognized that modifications and variations may readily occur to those skilled in the art and that such modifications and variations may be made without departing from the spirit and scope of our invention. Consequently, our invention as claimed below may be practiced otherwise than as specifically described above.

We claim:

1. A window security system adapted for use with a building possessing a window having a window frame and a window opening, said security system comprising:

a door mounted by at least one hinge to said window frame and disposed normally within said window opening, said door rotatable about said hinge between a closed position whereby the passage of an adult person through said window opening is substantially prevented and an open position whereby the passage of an adult person through said window opening is substantially permitted;

an electrically actuated strike or lock mounted to said door and adapted to extend into said window frame;

an electrically actuated latch plate rotatably mounted to said window frame and disposed in an adjacent, overlapping relation with said lock, said latch plate rotatable from a closed position whereby said lock is retained within said window frame and said door is maintained in a closed position and an open position whereby said latch plate is permitted to extend away from said window frame and said door assumes an open position;

a guard plate for substantially preventing access to said lock and to said latch plate from the exterior of the building when said door assumes a closed position;

a first solenoid for controlling the position of said latch plate between a closed position to an open position;

a first electric switch, said first electric switch being operable between an open position and a closed position;

a second solenoid for controlling the position of said first switch;

a sensor for detecting fire or other emergency condition within the building;

means responsive to said sensor for operating said second solenoid such that said second solenoid causes said first switch to assume a closed position whenever said sensor detects an emergency condition;

a source of electric power;

a second electric switch, said second electric switch being manually operable between an open position and a closed position;

a third electric switch, said third electric switch being manually operable between an open position and a closed position;

a first electric circuit operably connecting said power source to said first solenoid through said first electric switch and said second electric switch such that said first solenoid causes said latch plate to assume an open position when both said first switch and said second switch each assume a closed position; and a second electric circuit operably connecting said power source to said first solenoid through said third electric switch such that said first solenoid causes said latch plate to assume an open position when said third electric switch assumes a closed position.

2. A window security system according to claim 1 wherein said third switch is biased toward an open position.

3. A window security system according to claim 1 further comprising means for automatically creating a signal when said door assumes an open position.

4. A window security system according to claim 3 wherein said signal creating means creates an audible signal.

5. A window security system according to claim 3 wherein said signal creating means creates a visual signal.

6. A window security system according to claim 3 wherein said signal creating means includes:

a second source of electric power;

a fourth electric switch, said fourth switch assuming an open position when said door assumes a closed position and assuming a closed position when said door assumes an open position;

a fifth electric switch, said fifth electric switch being operable between an open position and a closed position;

a third solenoid for controlling the position of said fifth switch;

a sixth electric switch, said sixth electric switch being manually operable between an open position and a closed position;

means for generating a signal selected from the group consisting of an audio signal and a visual signal;

a third electric circuit operably connecting said second power source to said signal generating means through said fifth switch and said sixth switch such that said signal is actuated when said fifth switch and said sixth switch each assume a closed position; and a fourth electric circuit operably connecting said second power source to said third solenoid such that said fifth switch assumes a closed position only when said fourth switch assumes a closed position.

7. A window security system according to claim 1 further comprising means for biasing said door toward an open position.

8. A window security system according to claim 1 wherein said hinge comprises a spring hinge and wherein said spring hinge biases said door toward an open position.

9. A window security system according to claim 1 further comprising a wedge formed of resilient, compressible material disposed between said door and said window frame such that said wedge biases said door toward an open position.

10. A window security system according to claim 1 wherein said wedge is substantially permanently mounted in a position between said door and said window frame.

* * * * *